US010478987B1

(12) United States Patent
Lee et al.

(10) Patent No.: US 10,478,987 B1
(45) Date of Patent: Nov. 19, 2019

(54) CUTTING MODULE OF CUTTING MACHINE FOR WINDOW COVERING

(71) Applicant: Nien Made Enterprise Co., Ltd., Taichung (TW)

(72) Inventors: Wen-Yeu Lee, Tainan (TW); Chao-Hung Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/979,472

(22) Filed: May 15, 2018

(51) Int. Cl.

| | |
|---|---|
| ***B26D 7/02*** | (2006.01) |
| ***E06B 9/266*** | (2006.01) |
| ***B26D 5/10*** | (2006.01) |
| ***B26D 1/00*** | (2006.01) |
| ***B26D 1/06*** | (2006.01) |

(52) U.S. Cl.
CPC ..... *B26D 7/025* (2013.01); *B26D 1/0006* (2013.01); *B26D 1/06* (2013.01); *B26D 5/10* (2013.01); *E06B 9/266* (2013.01); *B26D 2001/006* (2013.01); *B26D 2001/0053* (2013.01)

(58) Field of Classification Search
CPC ..... B26D 7/026; B26D 7/0683; B26D 2007/013; B26D 23/00; B26D 11/00; Y10T 83/7487; Y10T 83/758; Y10T 83/1756; Y10T 83/7553; Y10T 83/222; Y10T 83/207; Y10T 83/4579; E06B 9/266; E06B 9/66
USPC ..... 83/451, 452, 113, 53.1, 131, 631, 167, 83/256, 196, 790, 467.1, 802, 788, 444, 83/522.11, 454, 639.1, 468.7, 648, 563
See application file for complete search history.

(56) References Cited

U.S. PATENT DOCUMENTS

| | | | | | |
|---|---|---|---|---|---|
| 475,782 | A * | 5/1892 | Luger | B23Q 3/005 | 144/253.1 |
| 1,022,176 | A * | 4/1912 | Boothby | B27C 5/06 | 144/243 |
| 4,132,256 | A * | 1/1979 | Jones | B23Q 3/002 | 144/250.2 |
| 6,647,845 | B1 * | 11/2003 | Ochi | B26D 7/025 | 83/139 |
| 8,839,703 | B2 * | 9/2014 | Kollman | B23D 23/00 | 83/196 |
| 2004/0112194 | A1 * | 6/2004 | Lin | B26D 7/025 | 83/452 |
| 2006/0112803 | A1 * | 6/2006 | Vossen | B26D 7/025 | 83/452 |
| 2010/0170375 | A1 * | 7/2010 | Kollman | B26D 7/04 | 83/452 |
| 2010/0313726 | A1 * | 12/2010 | Lee | B23D 23/00 | 83/200 |

* cited by examiner

*Primary Examiner* — Ghassem Alie
(74) *Attorney, Agent, or Firm* — Winston Hsu

(57) ABSTRACT

A cutting module adapted to trim a covering material of a window covering is disclosed, including a main body, a blade, and an elastic holding member. The main body has a first side, a second side, and a through hole communicating the first and the second sides, wherein the through hole can be passed through by the covering material. The blade is provided corresponding to the second side, and can be moved back and forth. The blade has a cutting edge, which passes over the through hole as the blade slides, whereby to cut off a part of the covering material beyond the second side. The elastic holding member is provided corresponding to the through hole to maintain the covering material at a predetermined position for cutting.

11 Claims, 14 Drawing Sheets

CUTTING MODULE OF CUTTING MACHINE FOR WINDOW COVERING

BACKGROUND OF THE INVENTION

1. Field of the Invention

The present invention relates generally to a window covering, and more particularly to a cutting module of a cutting machine for window coverings.

2. Description of the Prior Art

Generally speaking, the window coverings displayed in home accessories and furniture stores are manufactured by factories, which have limited specifications, and therefore would not be ready to be installed for windows of all kinds of sizes. Hence, consumers usually have to measure the windows before purchasing window coverings for the windows. With the measurements, window coverings of similar sizes can be selected out and trimmed to a suitable size. In this way, the trimmed window coverings can be installed on the windows to cover the windows appropriately.

To achieve the above purpose, home accessories and furniture stores are usually equipped with cutting machines, which can be operated by staffs to trim window coverings. A conventional cutting machine 1 is illustrated in FIG. 1 to FIG. 3, which includes a platform 10, an operating module 20, and a cutting module 30. The platform 10 is used to place a window covering which is going to be trimmed. The operating module 20 includes a handle 22, and the cutting module 30 includes a blade 32 and several through holes. In the current example, the cutting machine 1 can be used to trim horizontal window blinds, wherein one of the through holes 34 is adapted to let the slats of a window blind pass through, while the rest of the through holes are adapted to be passed through by other components (i.e., the headrail and the bottom rail) of the horizontal window blind. The motion of the blade 32 and that of the handle 22 are correlated. In other words, by pulling the handle 22, the blade 32 can be moved in a predetermined direction, which is a lateral direction in the current example. With such design, by simply placing a window covering on the platform 10 with parts of the components thereof extending beyond the through holes, and then by operating the handle 22 to move the blade 32, the parts of the components of the window covering which go beyond the through holes can be cut off.

In more details, while trimming the slats of a horizontal window blind, the horizontal window blind has to be placed on the platform 10 first, and then the slats thereof are neatly gathered to pass through the through hole 34. To ensure the quality of cutting, each of the through holes 34 should match the outline and size of the corresponding component of the window covering as closely as possible, so that the components of the window covering would not crack, and would not have rough edges after the cutting. Since the window blinds available on the market have slats of various widths and sizes, more than one mold would be provided along with the cutting machine, whereby the mold with a through hole suitable for the size of the slats can be applied to provide better cuttings. Or, on the premise not to change molds, the cutting machine could be provided with an enlarged mold, which has multiple through holes of different sizes to match slats of different sizes, or has a larger through hole which could allow larger slats to pass through. However, it is inconvenient to change and replace molds. Furthermore, the molds which are not in use may get lost, and there are possibilities that the selection among multiple molds may go wrong, resulting in inferior cuttings. On the other hand, enlarging the mold leads to a bulky cutting machine, which occupies more room, hindering the arrangement of available space and the convenience of operating the cutting machine. Therefore, the above two solutions are not so feasible. If there is only one large through hole provided, it would not be able to firmly hold slats of smaller sizes, which may cause some of the slats to slightly move as being pressed by the blade during the cutting process, producing uneven cuttings. In addition, the blade in a cutting machine is common to have symmetric chamfers, which can correspondingly cut out beautiful symmetric chamfers on the slats to provide an aesthetic feeling. But if the size of the through hole is too large for the slats, the slats may be placed at a bias position, or may slide during the cutting. As a result, the slats may not be cut evenly, or may only have a chamfer cut out on one side thereof, which would greatly reduce the quality of the finished products.

SUMMARY OF THE INVENTION

One aspect of the present invention is to provide a cutting module of a cutting machine for window coverings, and said cutting module could hold the covering materials of window coverings of different sizes at positions suitable for cutting.

An embodiment of the present invention provides a cutting module for trimming a window covering, wherein the window covering includes a covering material. The cutting module includes a main body, a blade, and an elastic holding member. The main body has two opposite sides, which are a first side and a second side, respectively. The main body further has a through hole communicating the first side and the second side, wherein the through hole is adapted to be passed through by the covering material of the window covering. The blade has a cutting edge, wherein the blade is provided corresponding to the second side of the main body, and is movable back and forth along a sliding path. The cutting edge passes over the through hole as the blade slides, and therefore is adapted to cut off apart of the covering material beyond the second side when the covering material passes through the through hole. The elastic holding member is provided corresponding to the through hole, and is adapted to exert an elastic force on the covering material when the covering material passes through the through hole to be trimmed, whereby to maintain the covering material at a predetermined position where the covering material does not contact at least a wall of the through hole.

With the design above, one single through hole would be capable of maintaining covering materials of different sizes at the predetermined position, whereby to ensure that covering materials could be evenly trimmed in spite of their various sizes, and would not move as being pressed by the blade while being cut. In this way, the outcome of the cutting process would be achieved as expected.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
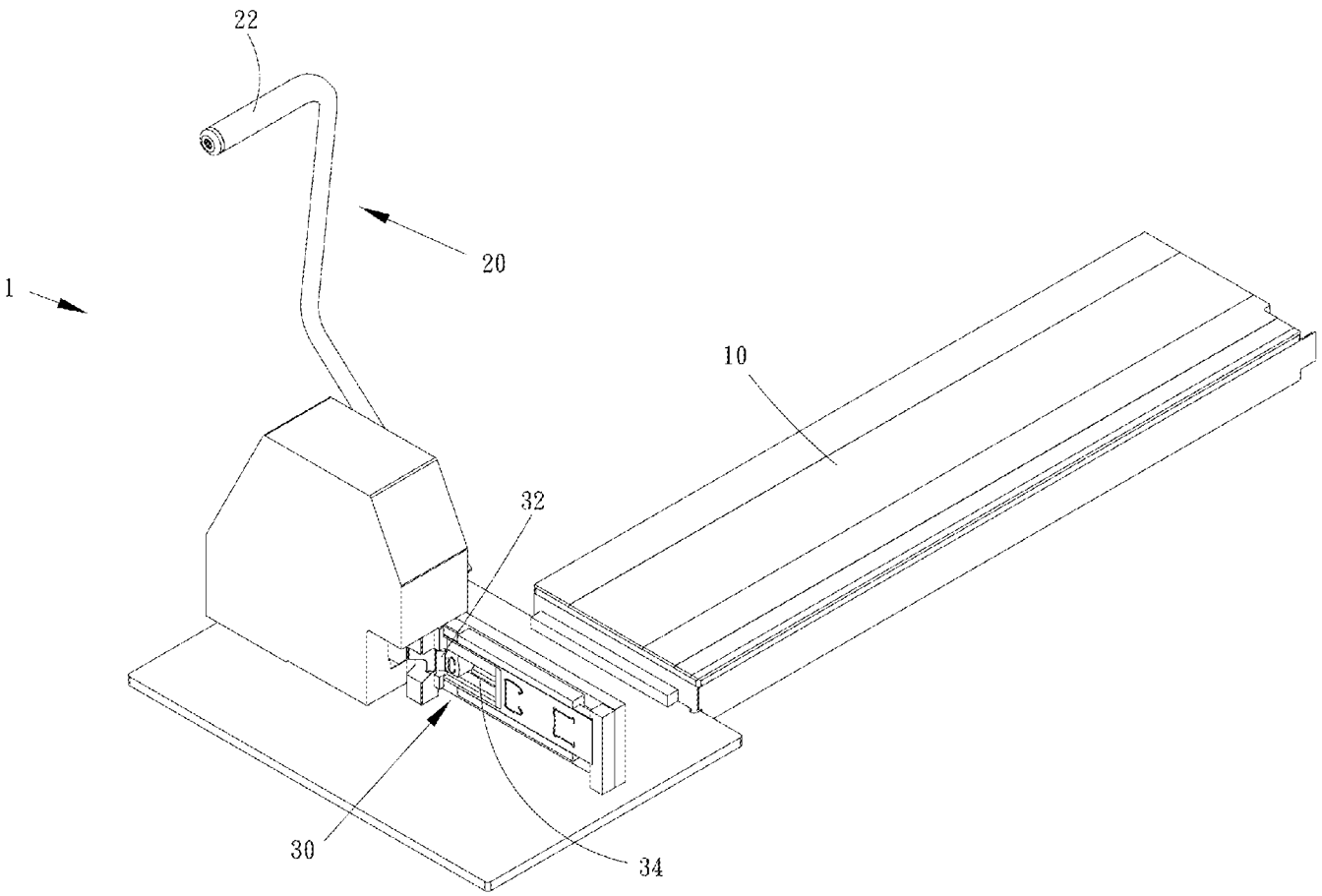
(PRIOR ART) FIG. 1
FIG. 1 is a schematic view of a conventional cutting machine for window coverings.
Figure 2:
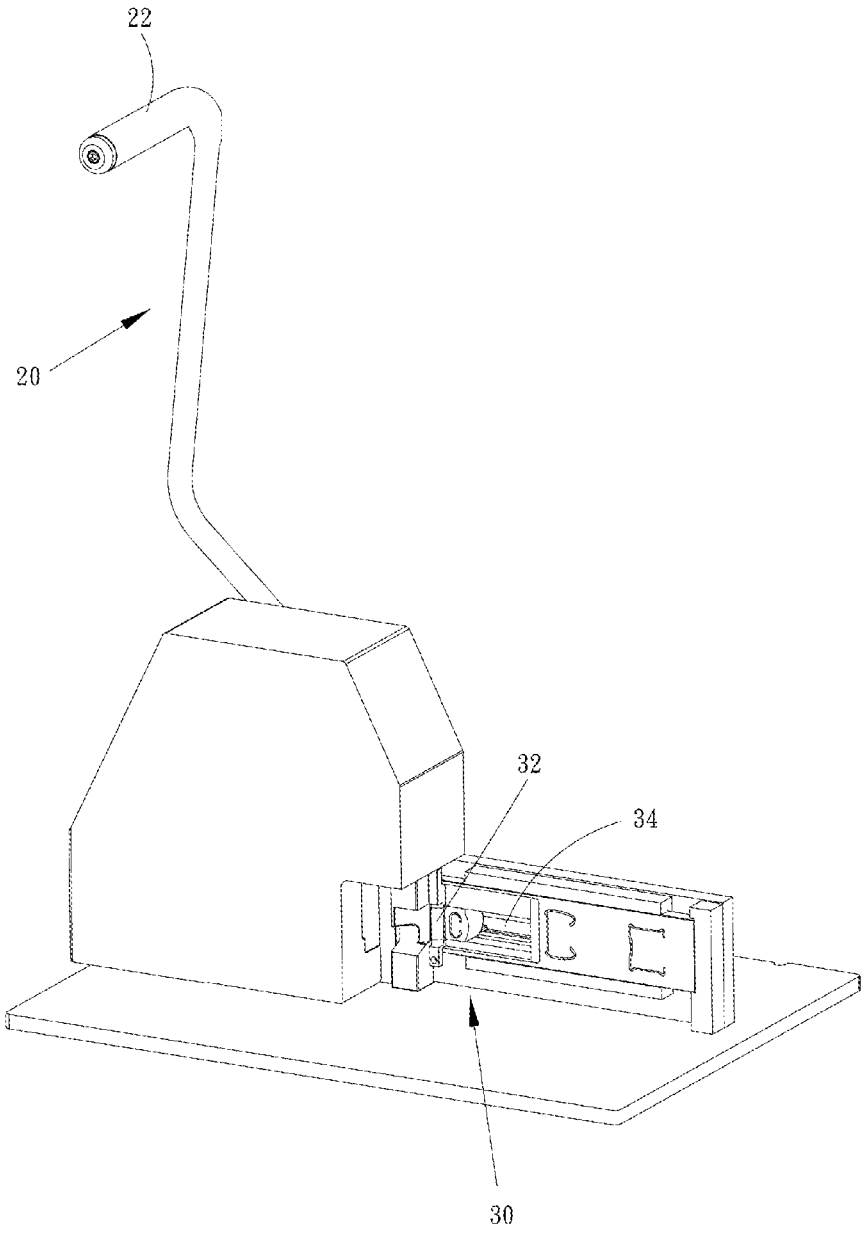
(PRIOR ART) FIG. 2
FIG. 2 is an enlarged partial perspective view of the conventional cutting machine shown in FIG. 1.
Figure 3:
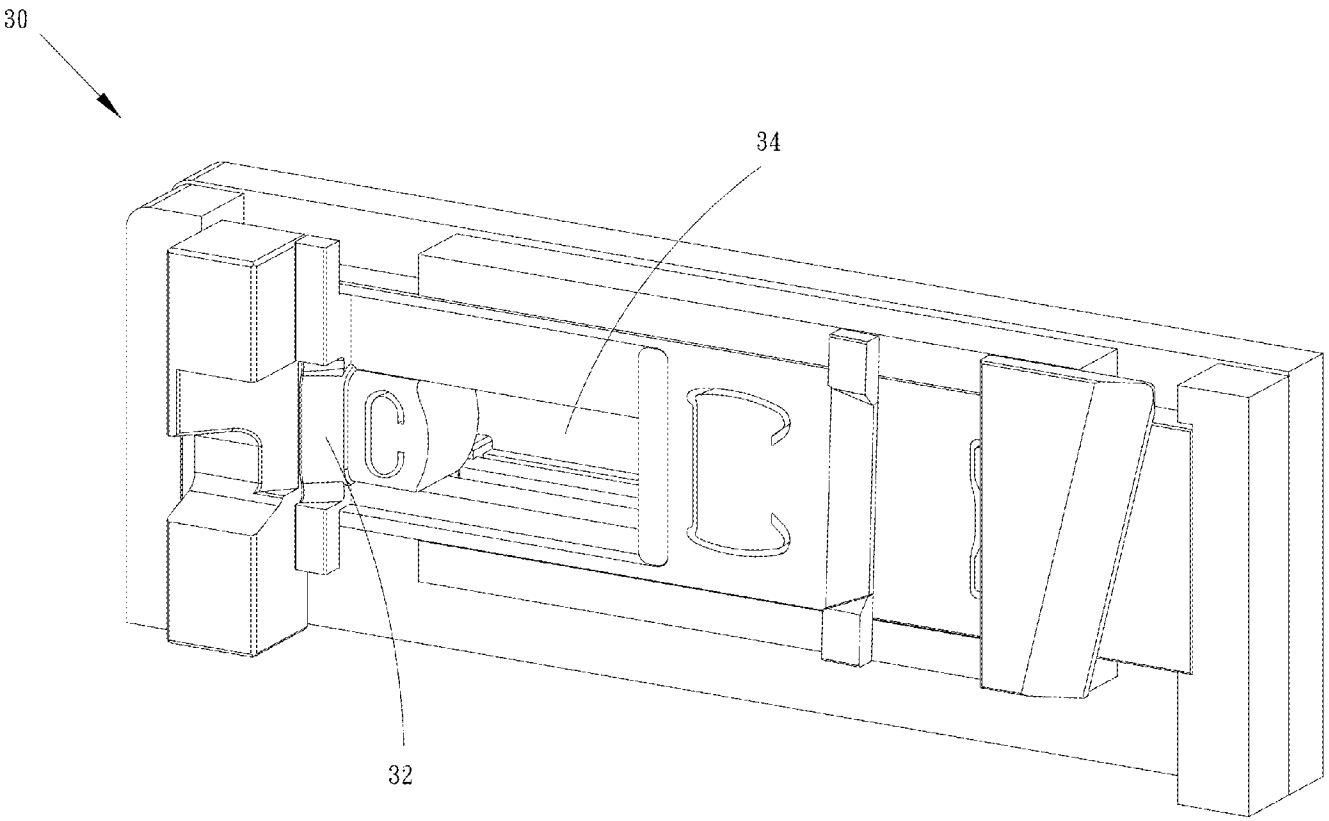
(PRIOR ART) FIG. 3
FIG. 3 is another enlarged partial perspective view of the conventional cutting machine shown in FIG. 1, showing the cutting module of the cutting machine.
Figure 4:
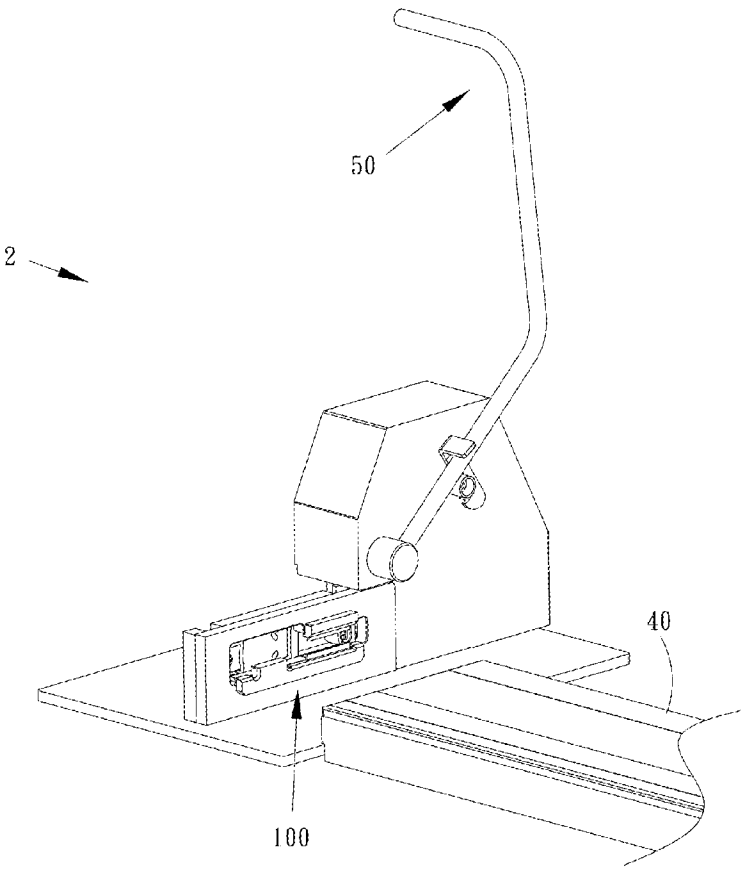
FIG. 4 is a perspective view of a cutting machine applied with the cutting module of the first embodiment of the present invention.

A cutting machine 2, which is applied with a cutting module 100 of a first embodiment of the present invention, is illustrated in FIG. 4, wherein the cutting machine 2 is adapted to trim window coverings, and also has, as the conventional cutting machine 1 mentioned above, a platform 40 and an operating module 50, wherein the platform 40 is adapted to place a window covering which is going to be trimmed, and the operating module 50 is adapted to be operated by a user, bringing the cutting module 100 into action to trim the window covering. However, the platform 40 and the operating module 50 are well-known components, and therefore we are not going to describe their details herein.

Figure 5:
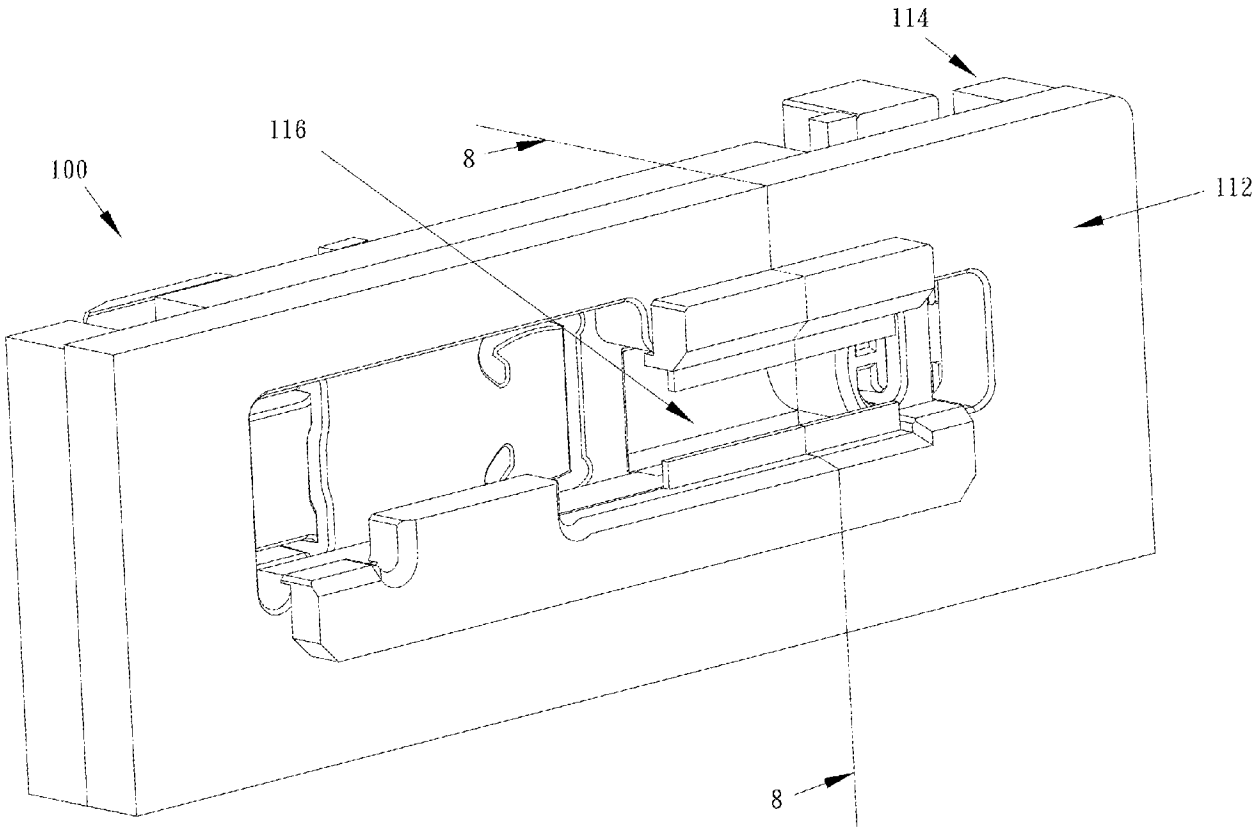
FIG. 5 is a perspective view of the cutting module of the first embodiment of the present invention.
Figure 6:
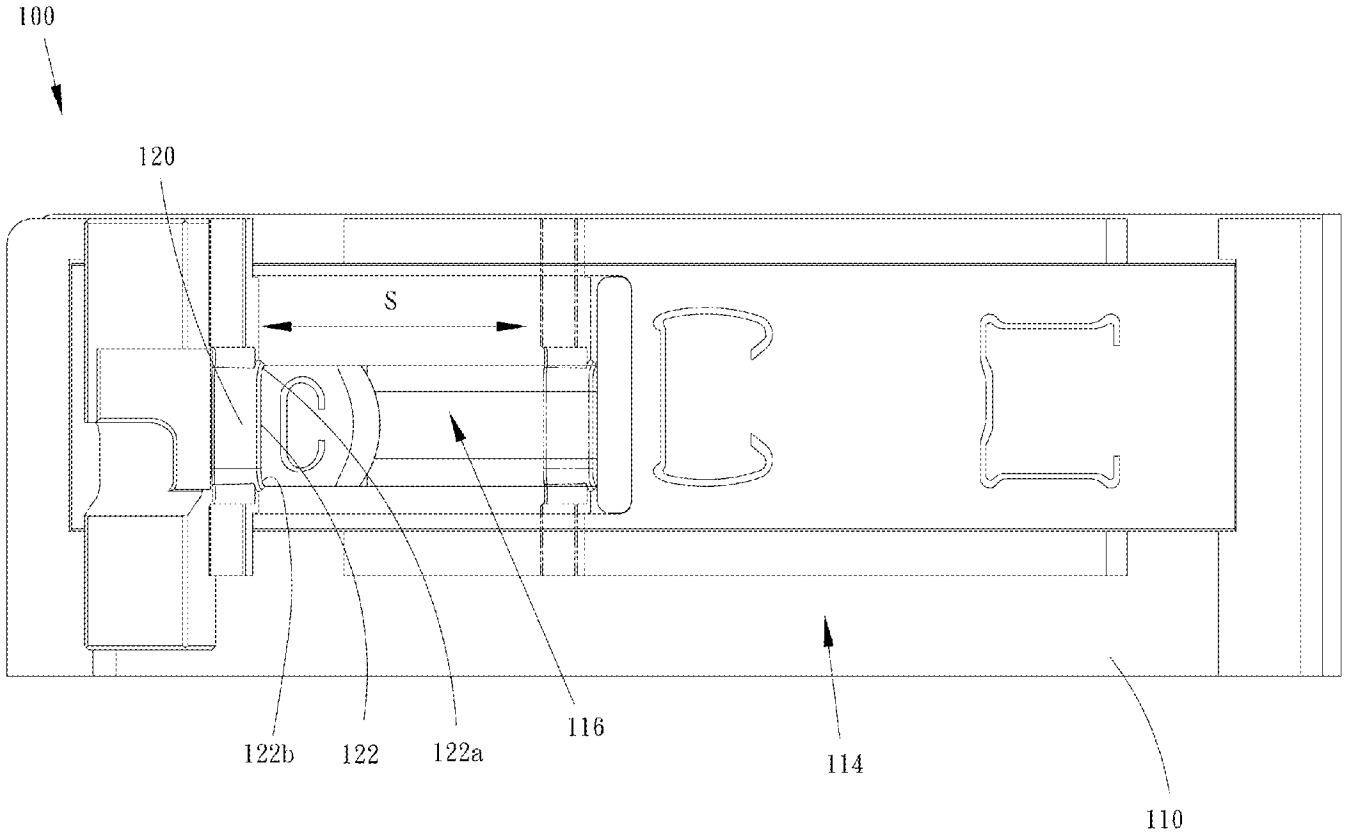
FIG. 6 is a perspective view of the cutting module shown in FIG. 5 viewed from another angle.

As shown in FIG. 5 and FIG. 6, which are perspective views of the cutting module 100 of the first embodiment of the present invention seen from different angles, the cutting module 100 includes a main body 110, a blade 120, and an elastic holding member. For the ease of explanation, two opposite sides of the main body 110 are respectively defined as a first side 112 and a second side 114, wherein the first side 112 faces the platform 40. The main body 110 is provided with a plurality of through holes communicating the first side 112 and the second side 114. Each of the through holes is adapted to be passed through by different component of the to-be-trimmed window covering, respectively. More specifically, the to-be-trimmed window covering should be placed on the platform 40, with the components (i.e., a headrail, a covering material, and a bottom rail) of the window covering respectively passing through one of the through holes from the first side 112 of the main body 110 toward the second side 114 thereof. One of the through holes is referred by reference character 116, referring to the through hole corresponding to the covering material of the window covering.

The blade 120 is provided corresponding to the second side 114 of the main body 110, and is adapted to be driven by the operating module 50, moving in a sliding and back-and-forth manner along a sliding path S, as shown in FIG. 6. The blade 120 has a cutting edge 122, which would pass over the through hole 116 on the second side 114 of the main body 110 when the blade 120 moved along the sliding path S, whereby a part of the covering material beyond the second side 114 could be cut off. In practice, each of the through holes of the main body 110 could have a blade provided respectively, or more than one through hole could share the same blade. In other words, the numbers of the blades and through holes, and the correspondences therebetween, are not limited by the exemplified embodiments described in the present invention. In the current embodiment, the blade 120 is directly provided on the second side 114 of the main body 110 in a movable manner, and the sliding path S thereof is in horizontal directions. However, these features are not limitations of the present invention; in other embodiments, the blade 120 could be provided at a position separated from the main body 110, or the sliding path S could be in directions other than horizontal ones, as long as the blade 120 could cut off the part of the covering material beyond the second side 114 of the main body 110.

Figure 7:
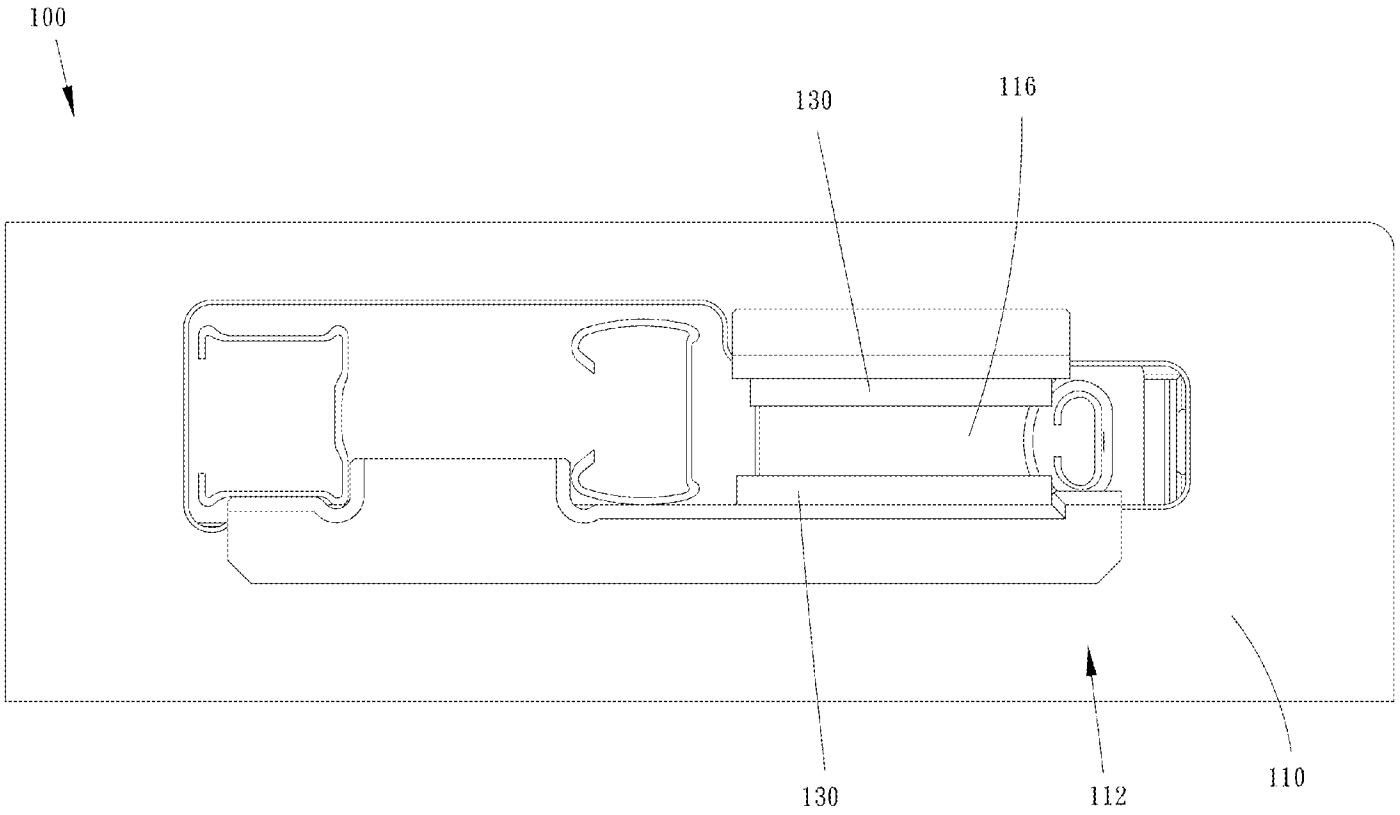
FIG. 7 is a front view of the cutting module shown in FIG. 5.
Figure 8:
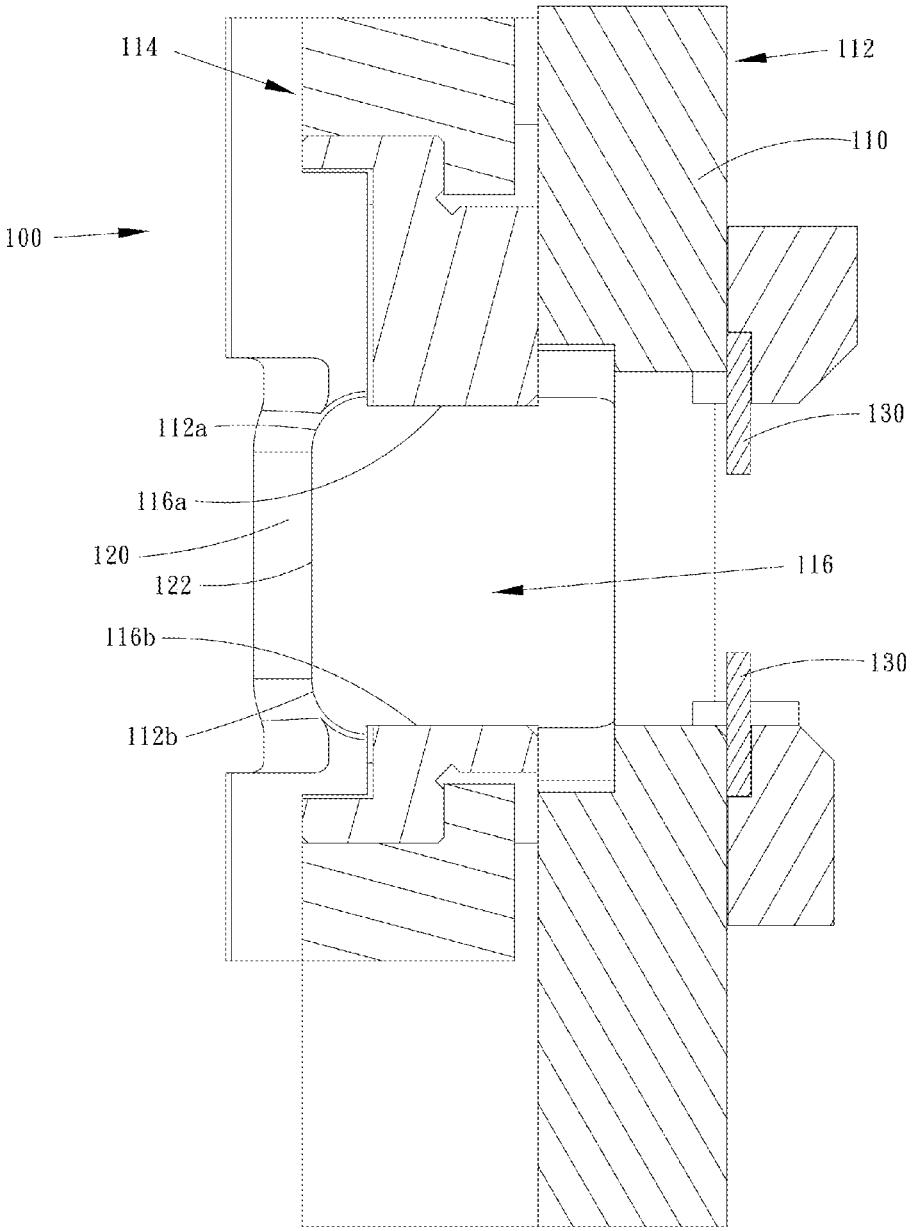
FIG. 8 is a sectional view of the cutting module shown in FIG. 5 along the 8-8 line.
Figure 9:
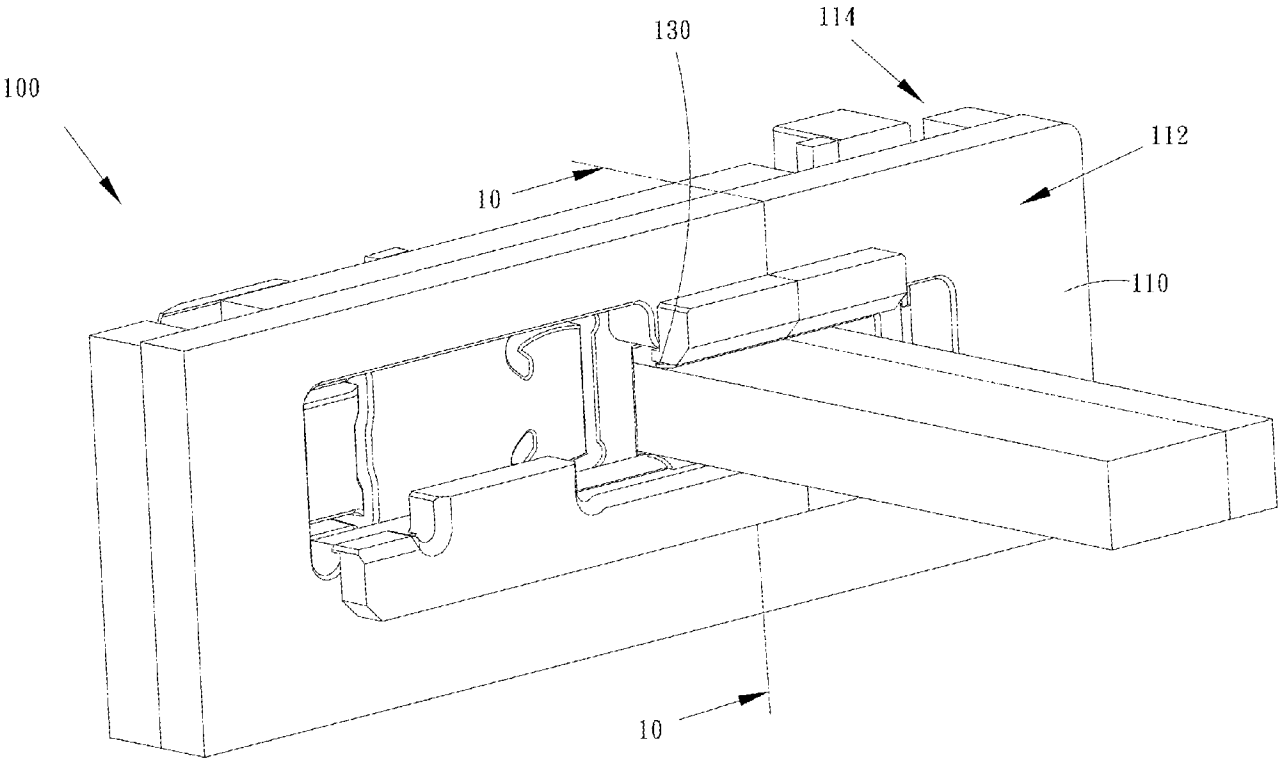
FIG. 9 is a schematic view, showing the condition when the cutting module shown in FIG. 5 is in use.
Figure 10:
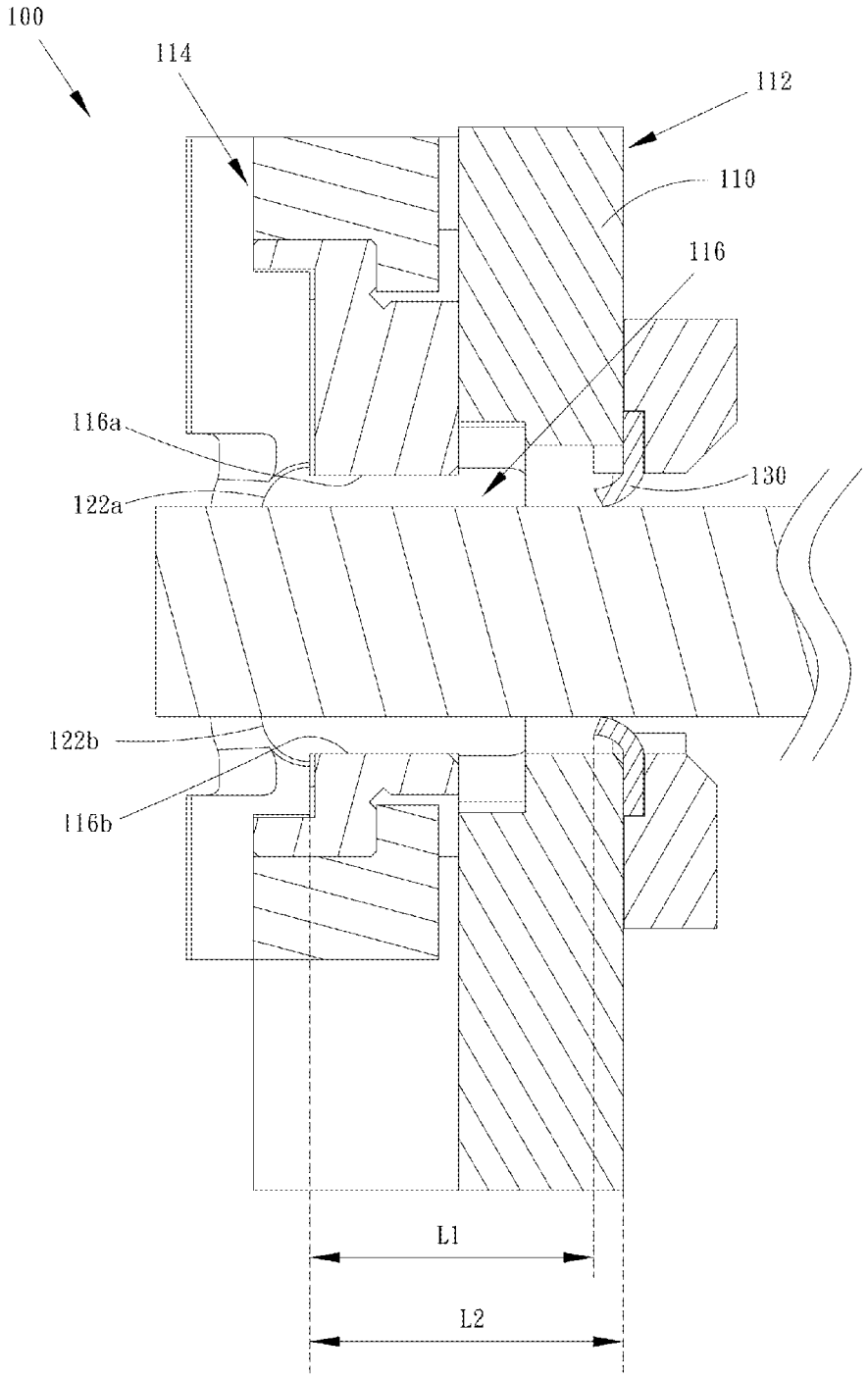
FIG. 10 is a sectional view of the cutting module along the 10-10 line in FIG. 9.

As shown in FIG. 7 and FIG. 8, the elastic holding member is provided corresponding to the through hole 116, and could maintain the to-be-trimmed covering material at a predetermined position through its elasticity. In the current embodiment, the elastic holding member includes two elastic plates 130 made of silicone rubber. However, the material is not limited to silicone rubber; other elastic materials would be also possible for making the elastic plates 130. The elastic plates 130 are provided on the first side 112 of the main body 110, wherein one of the elastic plates 130 is located on an upper side of the through hole 116, and the other one of the elastic plates 130 is located on a lower side of the through hole 116. As shown in FIG. 9 and FIG. 10, when the to-be-trimmed covering material passes through the through hole 116, the elastic plates 130 would be pressed by the covering material and deformed as being bent from the first side 112 of the main body 110 toward the second side 114 thereof. Since the elastic plates 130 are made of an elastic material, which is silicone rubber in the current embodiment, said deformation could produce an elastic force exerting on the covering material, whereby to maintain the covering material at the predetermined position. Of course, if the size of the covering material happens to match a distance between the elastic plates 130, the covering material could be maintained at the predetermined position without deforming the elastic plates 130. To be specific, a shortest distance (i.e., a straight line distance) in a direction from the first side 112 toward the second side 114 between the top end of any one of the elastic plates 130 and the second side 114 of the main body 110 is defined as a first length L1, and a depth of the through hole 116 communicating the first side 112 of the main body 110 and the second side 114 thereof is defined as a second length L2. When the elastic plates 130 are not deformed, the first length L1 would roughly equal the second length L2 in the current embodiment. On the other hand, if the size of the covering material is greater than the distance between the elastic plates 130, the elastic plates 130 would be deformed. Since the deformation is rendered in the form of bending toward the second side, the first length L1 would be less than the second length L2.

It needs to be specified that, the predetermined position mentioned herein refers to an appropriate location that the covering material can be evenly cut by the blade 120. More specifically, when the covering material is located at the appropriate location, it would be applied with the elastic force provided by the elastic plates 130, and would not contact at least a wall of the through hole 116. In the current embodiment, the predetermined position is a centered position in a vertical direction of the through hole 116, which is realized through the design shown in FIG. 9 and FIG. 10, wherein the elastic plates 130 are more protruded than an upper wall 116*a* and a lower wall 116*b* of the through hole 116, respectively. In this way, when the covering material passes through the through hole 116, it would not contact the upper wall 116*a* and the lower wall 116*b* of the through hole 116. Furthermore, a segment of the covering material located in the through hole 116 would be maintained at the centered position in the vertical direction of the through hole 116. However, said predetermined position is not necessary to be the centered position exemplified herein. In fact, the predetermined position could be a centered position in any specific direction of the through hole 116, wherein the vertical direction exemplified in the current embodiment is just one possibility among various directions. Preferably, the specific direction should be perpendicular to the sliding path S of the blade 120, for such arrangement could provide good cutting results. Or, in practice, the form and position of the elastic holding member could be designed based on the shape and the sliding path of the blade 120, and according to the through hole 116 and the specification of applicable covering material, such as providing the elastic holding member only on one wall of the through hole 116 (e.g., the upper wall 116*a*). With such design, when the covering material is located at the predetermined position, it could contact one wall of the through hole 116 (e.g., the lower wall 116*b*), but still not contact another wall of the through hole 116 (e.g., the upper wall 116*a*). The objective and effect of the present invention could be achieved as long as the covering material located at the predetermined position does not contact at least one wall of the through hole 116, and can be maintained at the predetermined position, for the covering material could be ensured to be evenly trimmed by the blade 120.

In addition, to avoid the deformation of the elastic plates 130 from affecting the cutting operation of the blade 120, no matter how large the covering material which goes into the through hole 116 is, and no matter to what extent the elastic plates 130 are therefore deformed, the top end of each of the elastic plates 130 should not exceed the second side 114 of the main body 110, or the top ends of the elastic plates 130 would be on the sliding path S of the blade 120, which would hinder the smooth operation of the blade 120. Furthermore, if the deformed elastic plates 130 got their top ends cut off by the blade 120, the effect of maintaining a covering material at the predetermined position would be reduced afterwards. Preferably, the top ends of the elastic plates 130 should keep appropriated distances from the opening of the through hole 116 on the second side 114 of the main body 110. In other words, the first length L1, which is, as defined above, the shortest distance in the direction from the first side 112 toward the second side 114 between the top end of any of the elastic plates 130 and the second side 114, would never be a negative value, for the elastic plates 130 would not exceed the second side 114 even when deformed.

Figure 11:
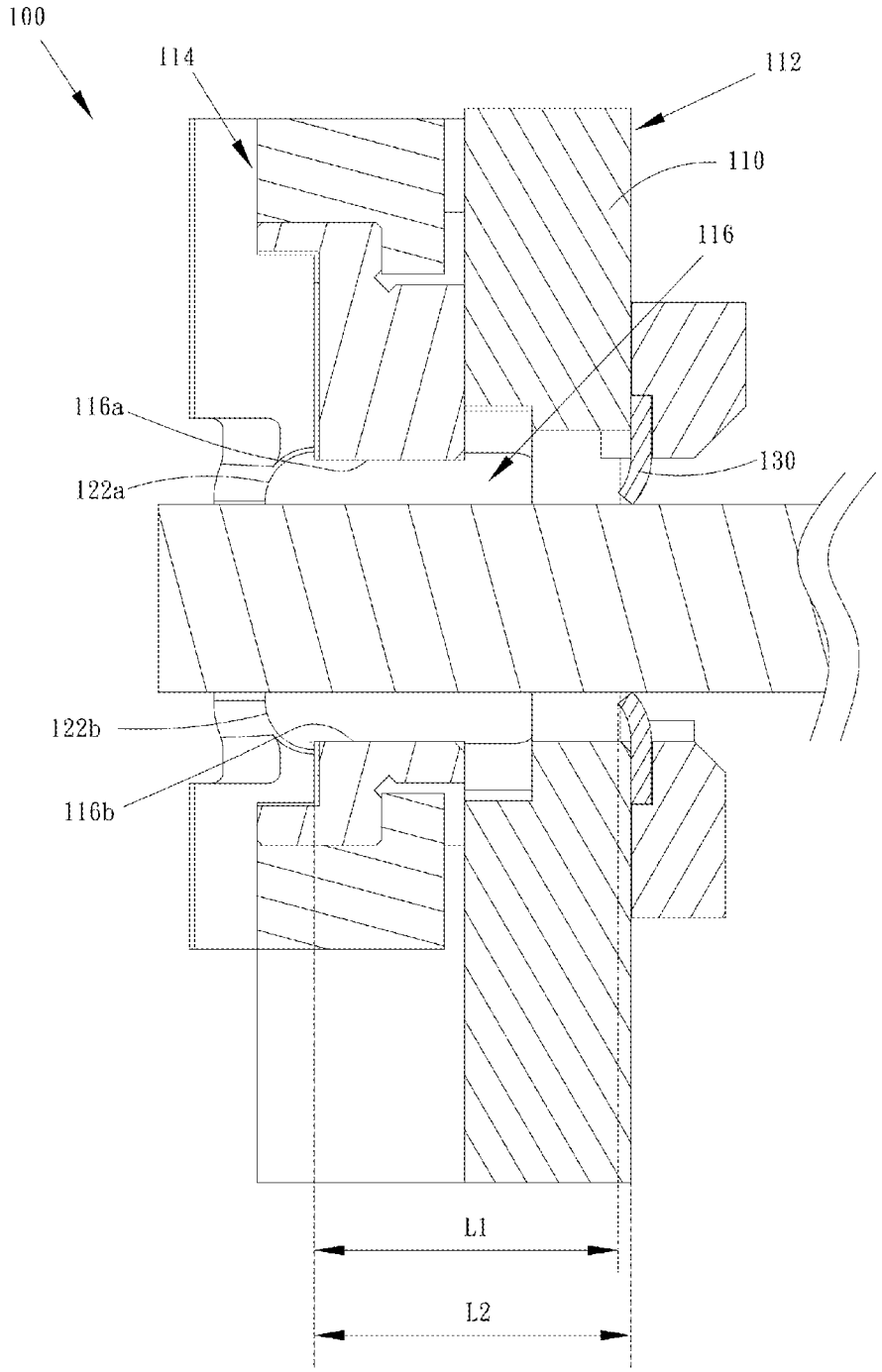
FIG. 11 is similar to FIG. 10, but the size of the covering material of the window covering which is being cut herein is different from that of the slat assembly seen in FIG. 9 and FIG. 10.

In the current embodiment, the cutting edge 122 is further provided with two symmetric chamfers 122*a*, 122*b*, which are adapted to leave corresponding chamfers on the trimmed covering material. To achieve the best cutting effect, when the to-be-trimmed covering material is located at the aforementioned predetermined position, and when the blade 120 passes over the through hole 116 along its sliding path S, the chamfers 122*a*, 122*b* of the cutting edge 122 should be able to symmetrically cut out two corresponding chamfers on the covering material. With the arrangement of the aforementioned elastic plates 130 and the through hole 116, the cutting module 100 would be compatible with covering materials of different sizes. More specifically, covering materials could be firmly maintained at the predetermined position in spite of their various sizes, for the elastic plates 130 could be correspondingly deformed in response to the size of the covering material passing through the through hole 116, whereby the segment of the covering material located in the through hole 116 could be supported by corresponding elasticity. In this way, it could be ensured that, when the blade 120 passes over the through hole 116, the covering materials of different sizes could be cut out two corresponding or qualified chamfers thereon. To better understand the concept, please refer to the usage scenario illustrated in FIG. 11, wherein a covering material of another window covering passes through the through hole 116 of the cutting module 100 of the present invention to be trimmed. The covering material is smaller than that is shown in FIG. 10, and therefore a deformation amount of the elastic plates 130 would be also less than that in the condition shown in FIG. 10. However, for the aforementioned reasons, the elastic plates 130 could also maintain the covering material in the usage scenario illustrated in FIG. 11 at the predetermined position, i.e., the centered position in the vertical direction, so that the covering material could be evenly cut by the chamfers 122*a*, 122*b* of the cutting edge 122. Similarly, if the to-be-trimmed covering material of a window covering is larger than that shown in FIG. 10, the elastic plates 130 would be deformed to a greater extent correspondingly, and therefore would apply a greater elastic force to the covering material, whereby to maintain the covering material at the predetermined position as well. In other words, the elastic holding member could enable the cutting module 100 of the present invention to trim covering materials of different sizes without needing to change molds. Furthermore, the cutting module 100 could provide good cutting effects.

Figure 12:
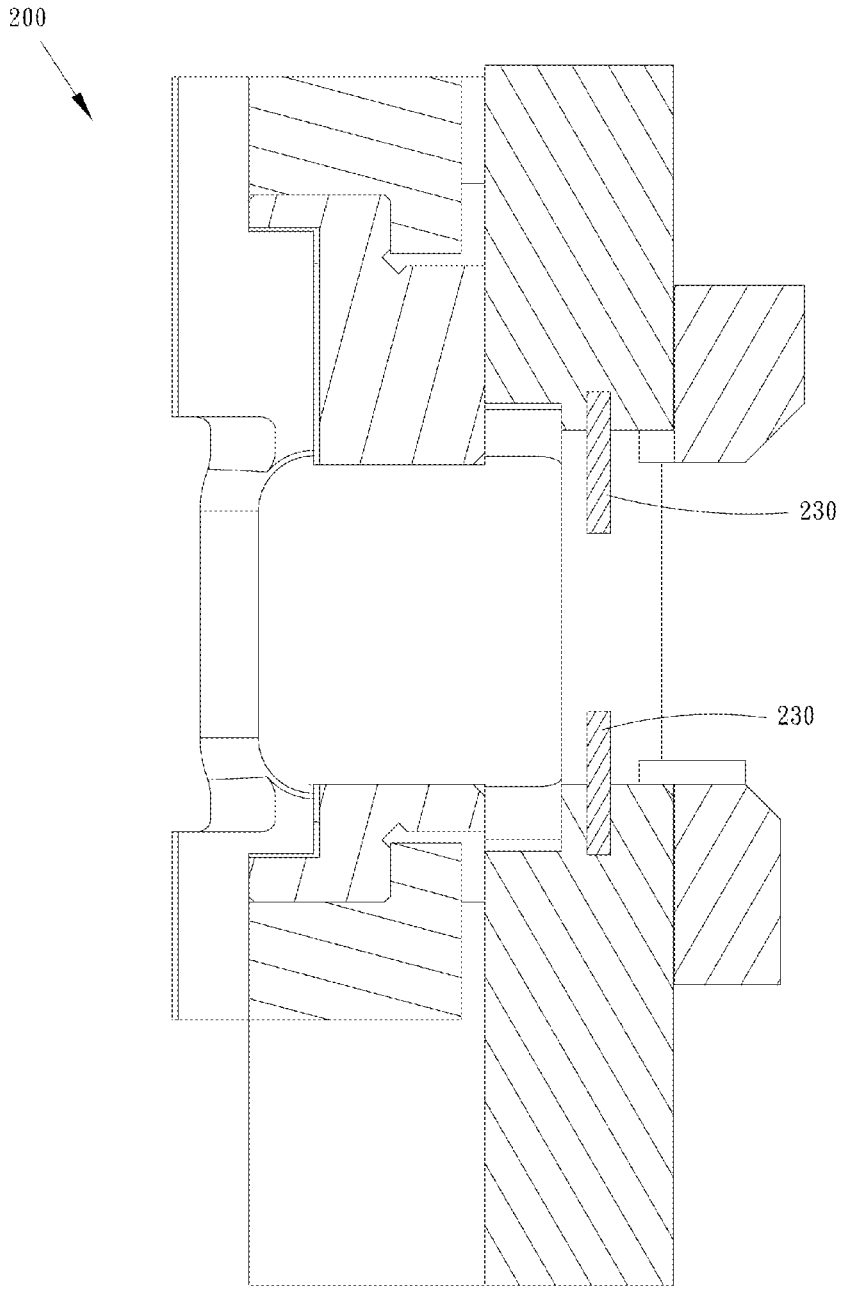
FIG. 12 is a sectional view of the cutting module of the second embodiment of the present invention, which is viewed from the same angle as FIG. 8.
Figure 13:
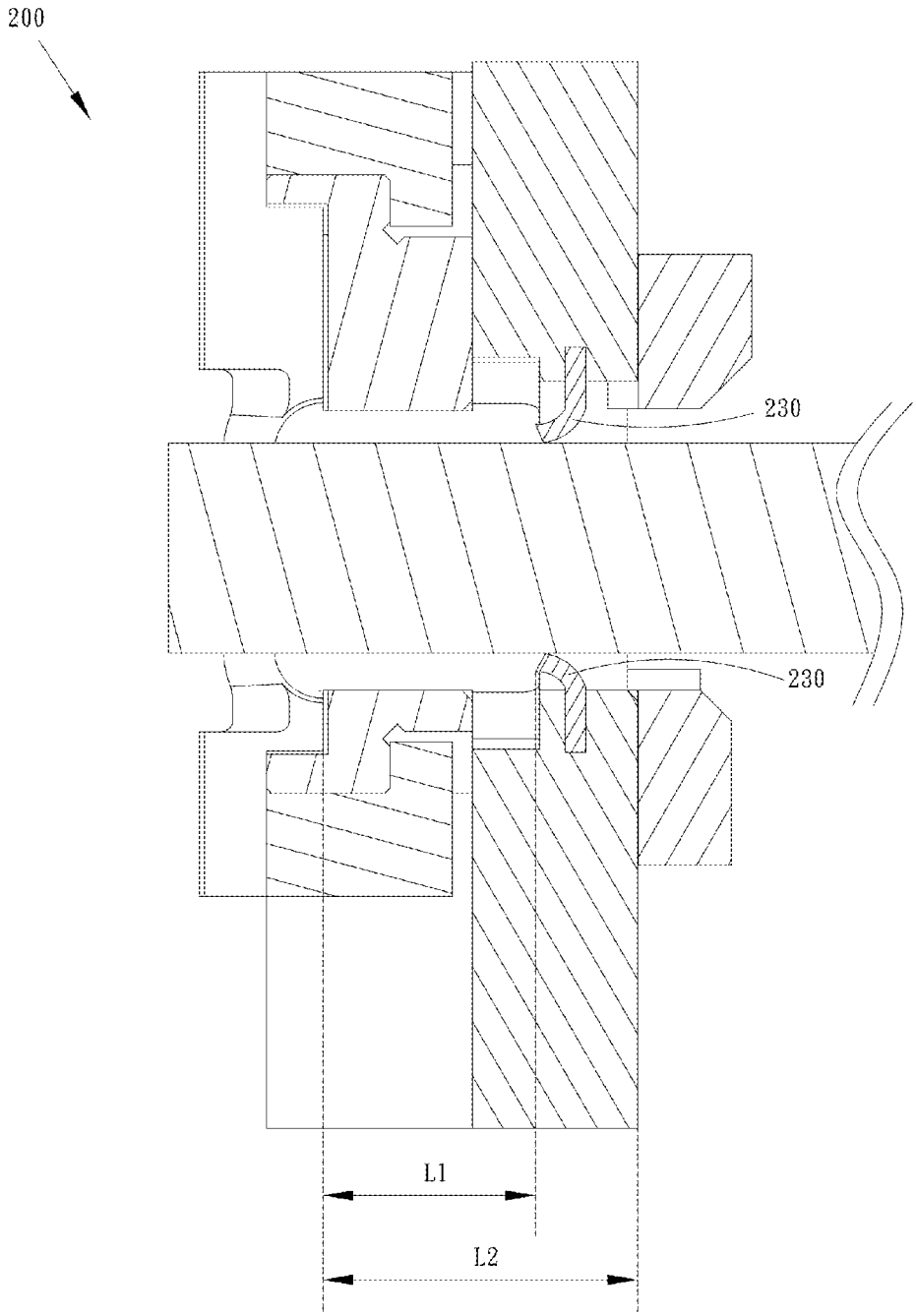
FIG. 13 is a sectional view of the cutting module shown in FIG. 12, showing the condition when the cutting module is in use as viewed from the same angle as FIG. 10.
Figure 14:
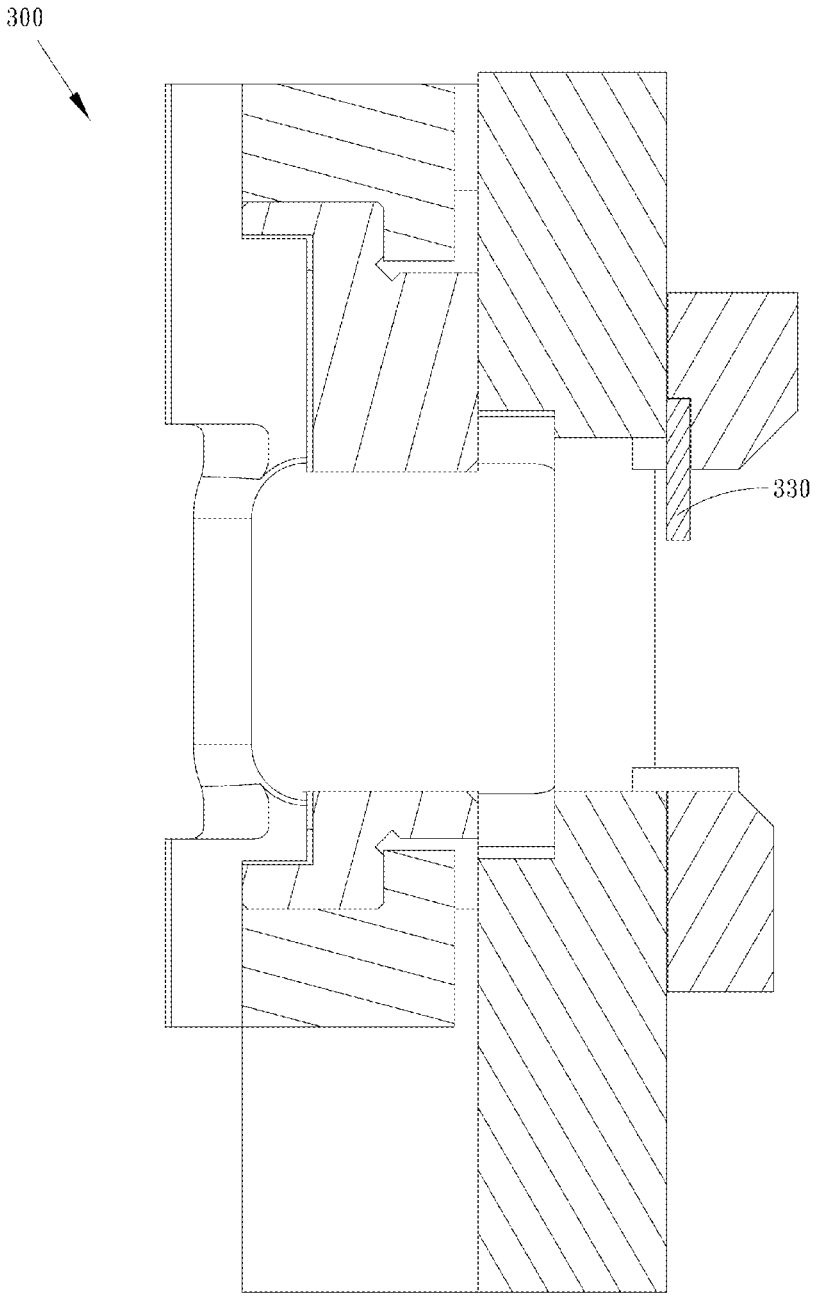
FIG. 14 is a sectional view of the cutting module of the third embodiment of the present invention, which is viewed from the same angle as FIG. 8 and FIG. 12.

In addition, though in the aforementioned embodiment, the number of the elastic plates 130 is two, and the elastic plates 130 are directly provided on the first side 112 of the main body 110 and are respectively located on the upper side and lower side of the through hole 116, the number and the locations of the elastic plates are not limitations of the present invention. A cutting module 200 of a second embodiment of the present invention is shown in FIG. 12 and FIG. 13, of which components are roughly the same as the cutting module 100 of the first embodiment, and therefore we still use the same reference characters for the components in the second embodiment. However, the differences between the first and the second embodiments are that, elastic plates 230 of an elastic holding member of the cutting module 200 of the present invention are provided inside a through hole 216, though the number of the elastic plates 230 is also two. In consideration of the aforementioned principle that the operation of the blade 120 should not be hindered, when the to-be-trimmed covering material of the window covering passes through the through hole 116 to deform the elastic plates 230, the elastic plates 230 should not exceed the second side 114 of the main body 110 as well, as shown in FIG. 13. Therefore, the first length L1 (i.e., the shortest distance in the direction from the first side 112 toward the second side 114 between a top end of each of the elastic plates 230 and the second side 114) in the second embodiment would not be a negative value, either. In addition, the first length L1 is, of course, less than the second length L2 (i.e., the depth of the through hole 116). Further, a cutting module 300 of a third embodiment of the present invention is shown in FIG. 14, of which the components are also roughly the same with those in the aforementioned embodiments, except that an elastic holding member thereof only includes an elastic plate 330, which is provided on an upper side of the through hole 116, and is on the first side 112 of the main body 110. Though the current embodiment only has one elastic plate 330, good cutting effects could be also achieved by providing an appropriately designed blade. In other embodiments, the elastic holding member is not necessary to be provided on the main body 110, and could be a stand-alone component instead. In principle, the cutting module of the present invention would work as long as the elastic holding member could be ensured to maintain the to-be-trimmed covering material at the predetermined position where the covering material does not contact at least a wall of the through hole. The position of the elastic holding member, whether it is directly provided on the main body 110 or not, and other related features are not the limitations of the present invention.

With the aforementioned designs of the cutting module, covering materials of different sizes could be firmly maintained at the predetermined position to be properly trimmed, without needing to change molds or have a size-adjustable through hole. A covering material maintained at the predetermined position would not slide though being pressed by the blade during the trimming operation, and could be evenly trimmed. If the blade has symmetric chamfers, the covering material could be also ensured to correspondingly have symmetric chamfers after being cut, whereby to give an aesthetic feeling.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A cutting module of a cutting machine for trimming a window covering, wherein the window covering comprises a covering material; comprising:

a main body, wherein the main body has two opposite sides, which are a first side and a second side, respectively; the main body has a through hole communicating the first side and the second side, wherein the through hole is adapted to be passed through by the covering material of the window covering;

a blade, which has a cutting edge, wherein the blade is provided corresponding to the second side of the main body, and is movable back and forth along a sliding path; the cutting edge passes over the through hole as the blade slides, and therefore is adapted to cut off a part of the covering material beyond the second side when the covering material passes through the through hole; and an elastic holding member, which is provided corresponding to the through hole, and is adapted to exert an elastic force on the covering material when the covering material passes through the through hole to be trimmed, whereby to maintain the covering material at a predetermined position where the covering material does not contact at least a wall of the through hole;

wherein the elastic holding member has two elastic plates which are adapted to provide the elastic force to the covering material passing through the through hole by being deformed, whereby to maintain the covering material at the predetermined position;

wherein the two elastic plates are provided on the first side of the main body on opposite sides of the through hole, respectively, to provide the elastic force on opposite sides of the covering material, wherein the elastic plates are configured to deform by the covering material toward the blade.

2. The cutting module of claim 1, wherein the elastic holding member is provided on the main body, and is adapted to maintain the covering material passing through the through hole at the predetermined position.

3. The cutting module of claim 1, wherein the cutting edge has two corresponding chamfers; when the elastic holding member maintains the covering material at the predetermined position, and when the blade slides and the cutting edge passes over the through hole, the chamfers of the cutting edge are adapted to cut out two corresponding chamfers on the covering material.

4. The cutting module of claim 1, wherein the predetermined position of the covering material maintained by the elastic holding member refers to a centered position in a predetermined direction of the through hole.

5. The cutting module of claim 4, wherein the predetermined direction is perpendicular to the sliding path of the blade.

6. The cutting module of claim 1, wherein the elastic holding member is provided on the first side of the main body.

7. The cutting module of claim 1, wherein the side on which one of the two elastic plates is provided on the main body is an upper side of the through hole, while the side on which the other one of the two elastic plates is provided is a lower side of the through hole.

8. The cutting module of claim 1, wherein the two elastic plates are deformed as being bent from the first side of the main body toward the second side thereof.

9. The cutting module of claim 8, wherein, when the two elastic plates are deformed, a top end of each of the elastic plates does not exceed the second side of the main body through the through hole.

10. The cutting module of claim 9, wherein a shortest distance between the top end of each of the elastic plates and the second side of the main body in a direction from the first side to the second side is defined as a first length, and a depth of the through hole communicating the first side and the second side of the main body is defined as a second length; when the cover material passes through the through hole, the first length is less than or equal to the second length.

11. The cutting module of claim 1, wherein the two elastic plates are made of silicone rubber.

* * * * *